United States Patent [19]

Green

[11] Patent Number: 4,700,533

[45] Date of Patent: Oct. 20, 1987

[54] DEVICE FOR STACKING AND WRAPPING COINS

[76] Inventor: Frank L. Green, 9026 N. 128th St., Scottsdale, Ariz. 85259

[21] Appl. No.: 894,005

[22] Filed: Aug. 7, 1986

[51] Int. Cl.[4] ..... B65B 9/10; B65B 67/02

[52] U.S. Cl. ..... 53/532; 53/542; 53/567; 53/254; 53/390

[58] Field of Search ..... 53/532, 540, 542, 567, 53/213, 219, 390, 254, 469

[56] References Cited

U.S. PATENT DOCUMENTS

| | | | |
|---|---|---|---|
| 2,215,858 | 9/1940 | Slootsky | 53/254 |
| 2,620,109 | 12/1952 | Smathers | 53/254 |
| 2,645,397 | 7/1953 | McCallick et al. | 53/254 |
| 3,120,235 | 2/1964 | Ferrell | 53/254 X |
| 3,382,647 | 5/1968 | Davey et al. | 53/532 |
| 3,505,777 | 4/1970 | Tsutsumi | 53/532 X |
| 3,619,978 | 11/1971 | Graham | 53/254 X |
| 3,678,650 | 7/1972 | Green, Jr. | 53/532 |
| 3,882,659 | 5/1975 | Charlop | 53/254 |

*Primary Examiner*—Horace M. Culver

*Attorney, Agent, or Firm*—Don J. Flickinger; Jordan M. Meschkow

[57] ABSTRACT

Several troughs, each having an open end and a closed end, are formed into a body. Each trough is sized to receive and stack a predetermined number of coins of a selected denomination. A movable member, coupled to the body, detachably holds several tube type wrappers. In response to movement in one direction, the movable member closes the open end of each trough. In response to movement of the movable member in the opposite direction each wrapper is aligned with a respective trough. As the body is tilted, the stack is guided into the wrapper.

24 Claims, 17 Drawing Figures

FIG. 1
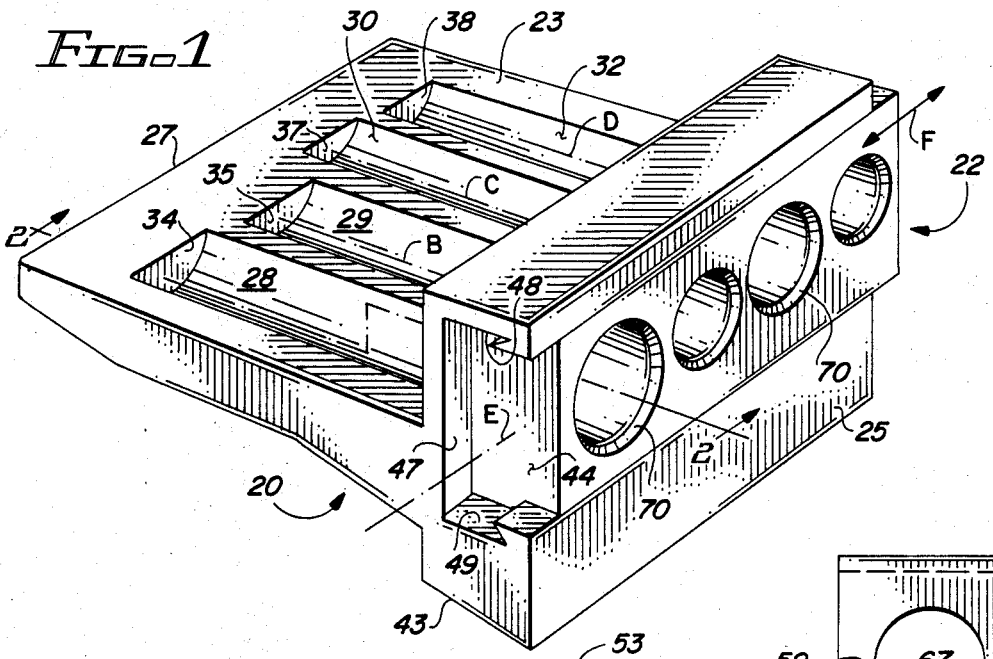
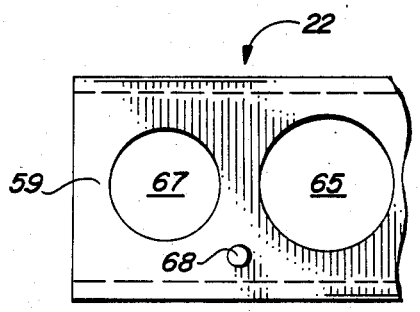
FIG. 5
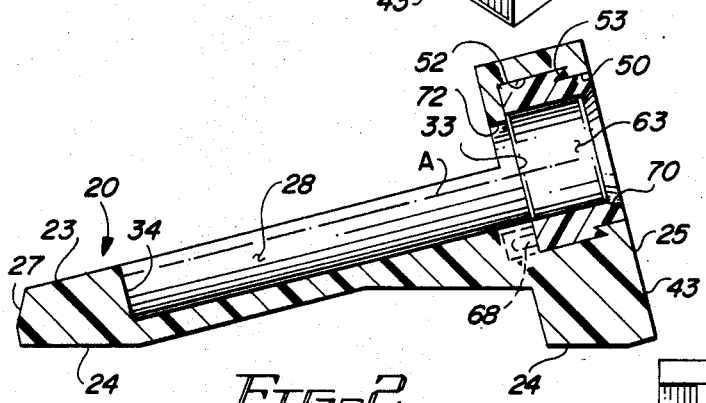
FIG. 2
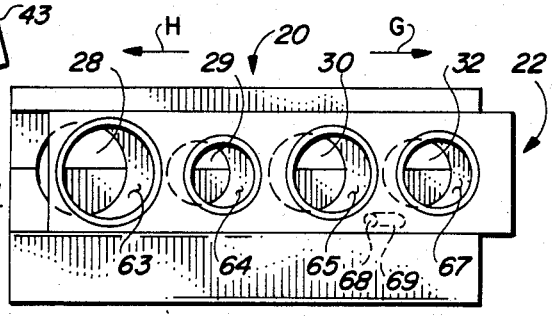
FIG. 4
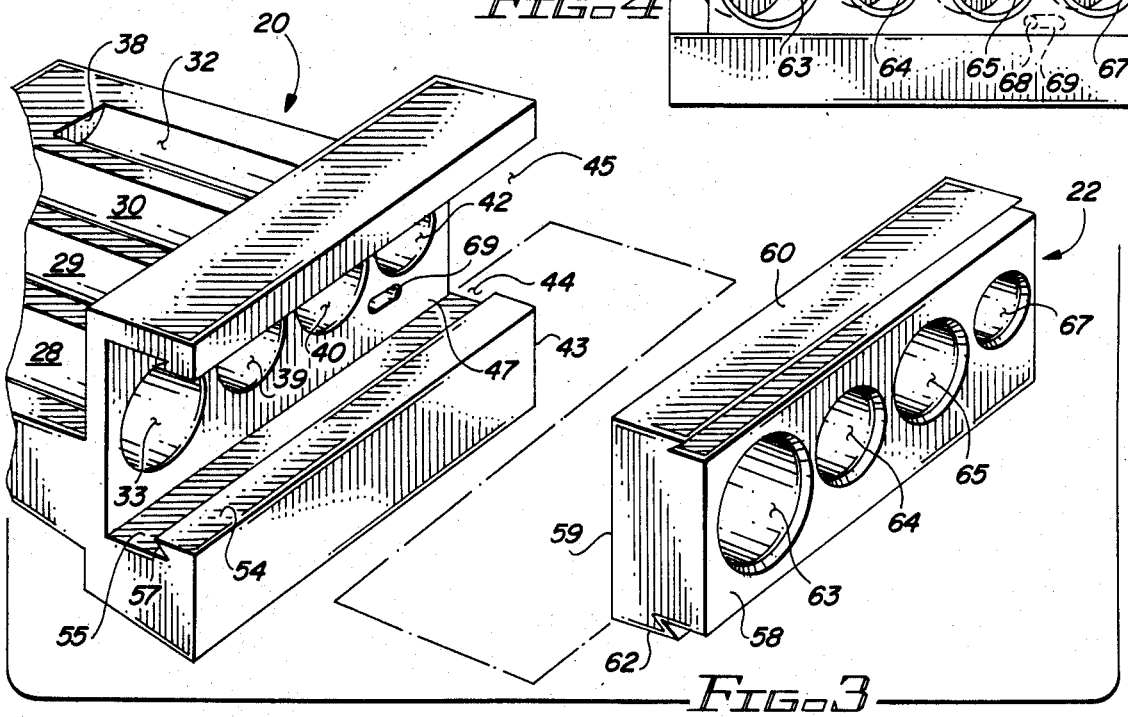
FIG. 3

FIG. 6
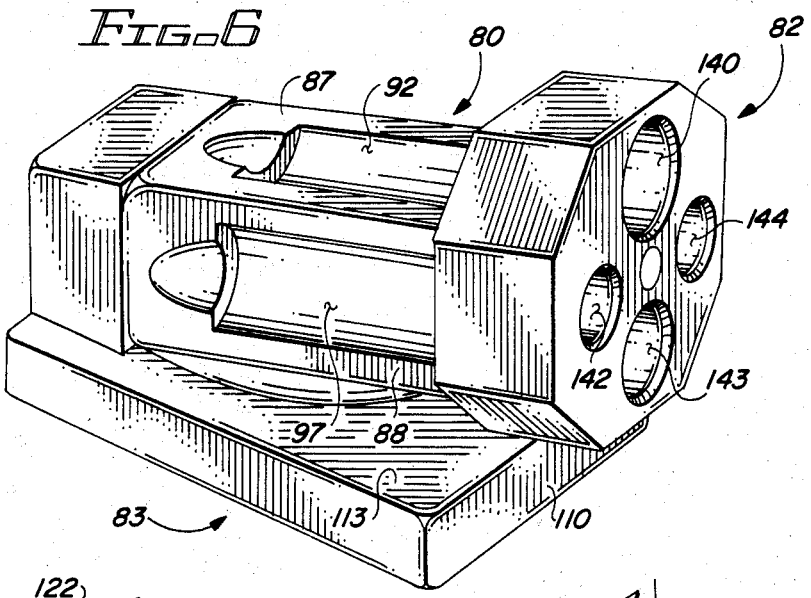
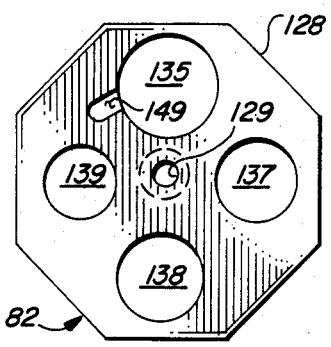
FIG. 10
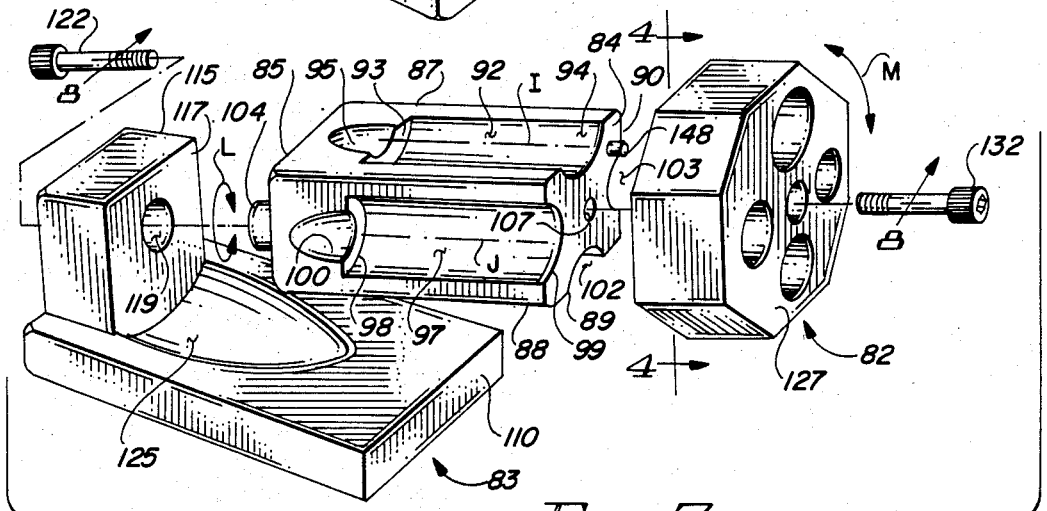
FIG. 7
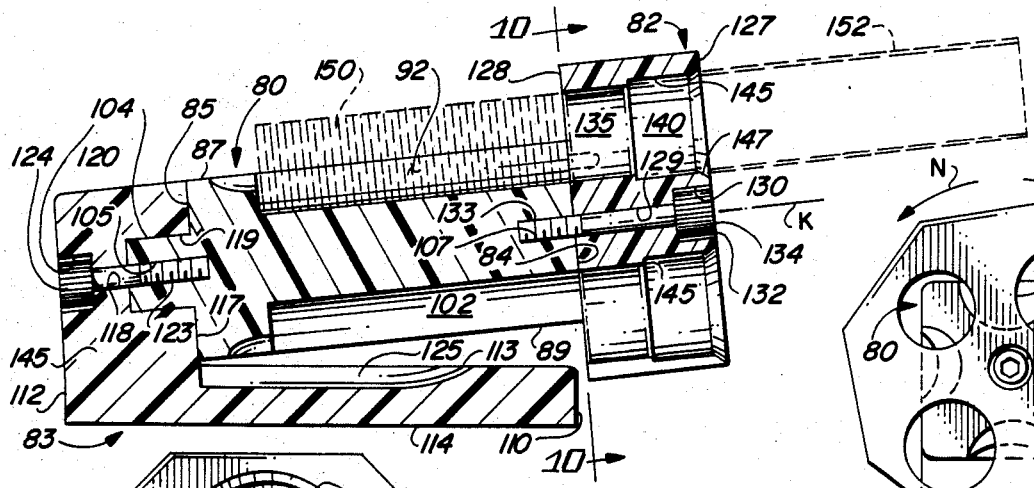
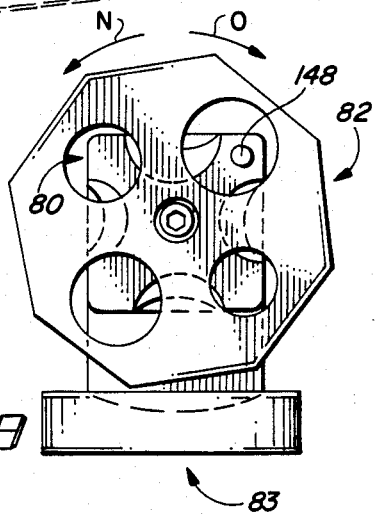
FIG. 9
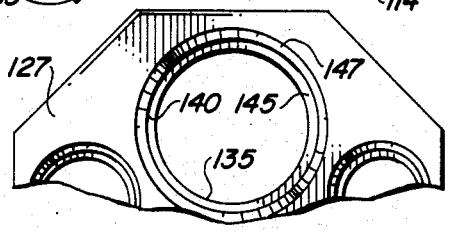
FIG. 11

FIG. 12
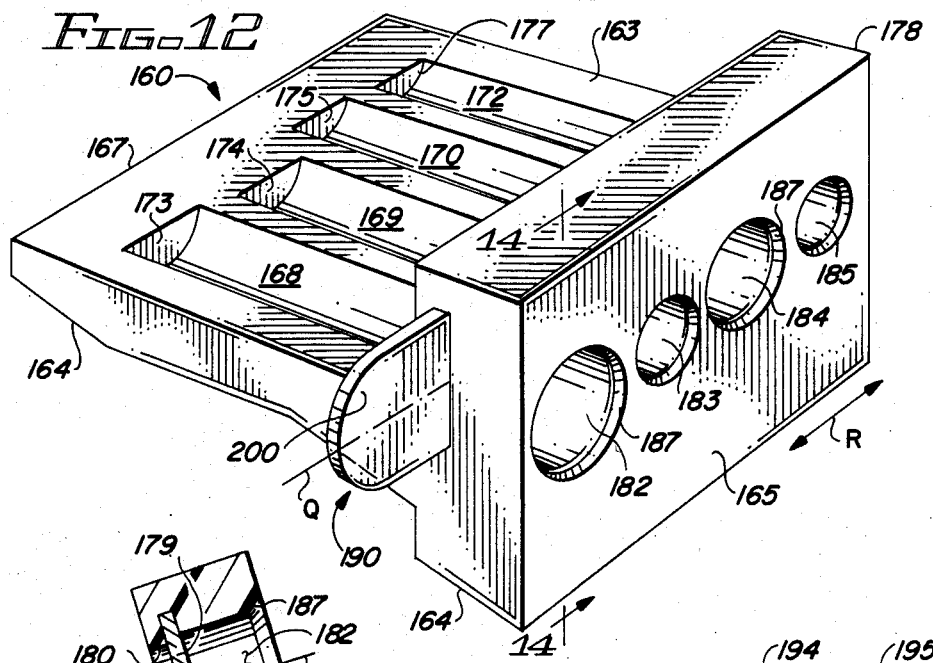
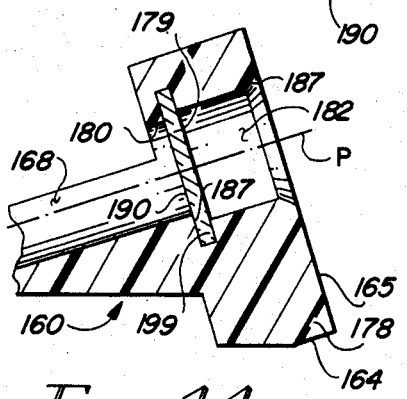
FIG. 14
FIG. 13
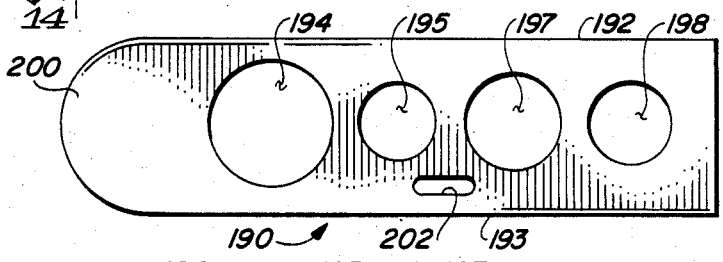
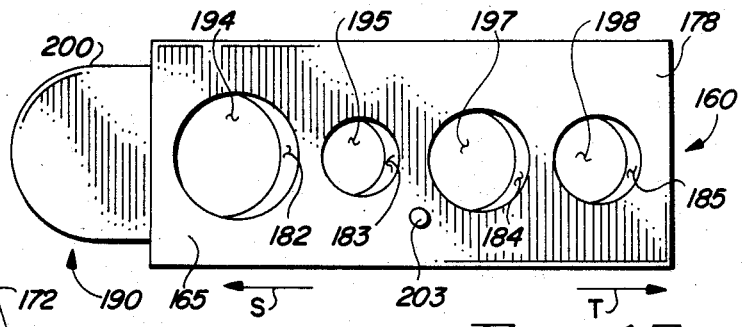
FIG. 15
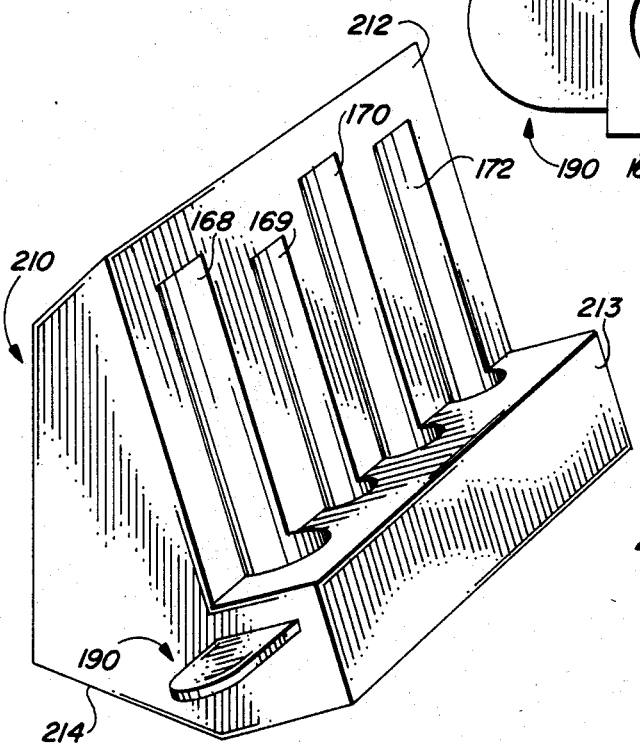
FIG. 16
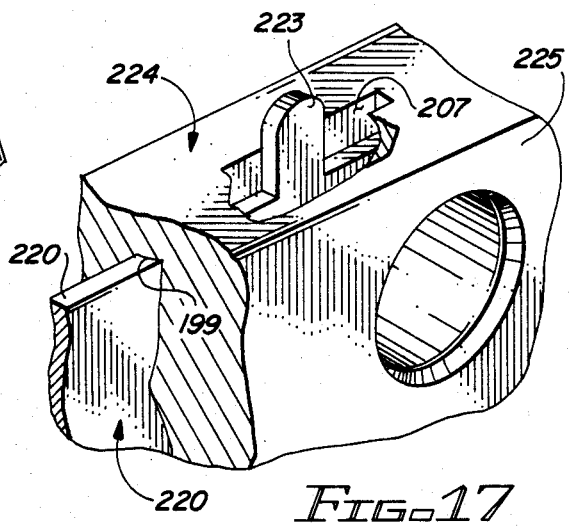
FIG. 17

DEVICE FOR STACKING AND WRAPPING COINS

BACKGROUND OF THE INVENTION

1. Field of the Invention

This invention relates to coin handling devices.

More particularly, the present invention relates to devices for stacking and wrapping coins.

In a further and more specific aspect, the instant invention concerns an improved device for receiving a predetermined number of coins of assorted denominations and for transfer of the coins into respective tubular wrappers.

2. Background Information

Coins comprise a significant portion of the currency which is exchanged on a frequent basis by business establishments of various sizes and by individuals. Denominations of coins in general usage are limited to pennies, nickels, dimes and quarters. Other denominations are available but are not commonly in circulation.

For orderly and convenient stowage it is desirable, and frequently required by banking institutions, that coins in quantity be packaged in rolls. This requires that the coins be sorted by denomination, stacked in predetermined quantities and placed in appropriate tubular wrappers. A roll of quarters, for example, contains forty coins having a value of five dollars.

Manual rolling of coins is a tedious task requiring well developed manual dexterity to accomplish any degree of efficiency. In attempting to expedite the task, the prior art has provided various devices. In general, the known devices include complex, sophisticated machines especially adapted for use by financial institutions. Also known, are exceedingly simple devices which perform only a simple function such as stacking previously sorted and counted coins. It is noted that the prior art has provided various coin handling apparatus for use in connection with sheet type wrappers. However, since sheet wrappers have almost entirely been replaced by tubular wrappers such apparatus are currently of limited value.

SUMMARY OF THE INVENTION

It could be highly advantageous, therefore, to remedy the foregoing and other deficiencies inherent in the prior art.

Accordingly, it is an object of the invention to provide improvements in coin handling devices.

Another object of the present invention is the provision of an improved device for stacking coins and subsequently transferring the coins into tubular wrappers.

And another object of the invention is to provide a coin rolling device which can accommodate a single denomination of coins of assorted denominations.

Still another object of the instant invention is the provision of a device in which the coins are stacked in predetermined quantities without necessity of manual counting.

Yet another object of the invention is to provide a coin stacking and wrapping device especially adapted for use by those routinely handling moderate numbers of coins.

Yet still another object of the invention is the provision of a device which assists in the manual sorting of coins of randomly selected denominations.

And a further object of the invention is to provide a device that is exceedingly compact and of light weight for convenient stowage.

Still a further object of the immediate invention is the provision of a coin stacking and wrapping device that is highly efficient and easily usable.

Yet a further object of the invention is to provide a device which may be fabricated in alternate configurations and of various materials.

And still a further object of the invention is the provision of a device of the foregoing character which is exceedingly durable and relatively inexpensive to manufacture.

Briefly, to achieve the desired objects of the instant invention in accordance with a preferred embodiment thereof, provided are first means for receiving and stacking coins of selected denominations and second means carried by the first means for holding a tubular wrapper. The second means are movable relative the first means between a first position for limiting the first means for receiving a predetermined number of coins and a second position for transfer of the predetermined number of coins to the tubular wrapper. The first position and the second position are reached in response to movement of the second means in respective first and second opposite directions. The second means are provided with engagement means for receiving and removably holding a tubular wrapper. Guide means direct the coins from the first means into the tubular wrapper when the second means is in the second position.

In accordance with a further embodiment of the invention, there is provided a body including at least first stacking means for receiving a first quantity of coins and second stacking means for receiving a second quantity of coins. Further provided is a movable member carried by the body portion and including at least first engagement means for removably holding a first tubular wrapper for receiving the first quantity of coins and second engagement means for removably holding a second tubular wrapper for receiving the second quantity of coins. The movable member is selectively positionable between a first position for limiting the first and second stacking means to receiving a predetermined quantity of coins and a second position for transfer of the first and second quantity of coins into the respective tubular wrapper.

In a preferred embodiment, each stacking means includes a trough for receiving in stacked arrangement the respective quantity of coins and having a closed end, an open end, and a length intermediate the ends corresponding to the stacked quantity of coins. Stop means carried by the movable member closes the open end of the trough in opposition to the closed end when the movable member is in the first position. Guide means, reside proximate each of the engagement means and the open end of the respective troughs. A preferred guide means is in the form of a bore extending through the movable member and sized to receive the respective quantity of coins therethrough and the engagement means includes a counterbore carried by the movable member and sized to removably receive the respective wrapper.

In accordance with an embodiment of the invention, the body includes a surface having the first and second stacking means formed therein and extending along substantially parallel axes. The movable member is positionable in opposite directions along a linear axes substantially perpendicular to the axis of the stacking means. Also included are limit means for limiting movement of the movable member in the opposite directions along the linear axis.

In accordance with an alternately preferred embodiment of the invention, the body portion includes a first surface carrying the first stacking means and a second surface angularly disposed to the first surface and carrying the second stacking means. Each of the stacking means extends along one of a pair of parallel axis. The movable member is movable between the first and second positions in opposite directions about an axis of rotation which is substantially parallel to the axis of the stacking means. The device may further include a stationary base and mounting means for rotatably securing the body to the base for rotation between a first position in which the first stacking means is positioned for receiving the first quantity of coins and a second position in which the second stacking means is positioned for receiving the second quantity of coins.

In accordance with yet another embodiment of the invention there is provided a body including at least first stacking means for receiving a first quantity of coins and at least first engagement means for removably holding a tubular wrapper. A slide member is movably carried by the body intermediate the stacking means and the engagement means. The slide member is reciprocally movable between a first position for limiting the stacking means to a predetermined quantity of coins and a second position in which the quantity of coins is transferable into the tubular wrapper. More specifically, the stacking means is in the form of a trough having an open end proximate the slide member and a closed end spaced in opposition to the open end. The trough extends along a longitudinal axis which is also the axis of the engagement means. The slide member, which is movable in opposite linear directions along an axis substantially perpendicular to the axis of the stacking means, includes a solid portion for limiting the stacking means to a predetermined quantity of coins when in the first position and an opening for passage of the coins therethrough when in the second position. Further provided are guide means integral with the open end of the trough and coaxial with the longitudinal axis thereof.

BRIEF DESCRIPTION OF THE DRAWINGS

The foregoing and further and more specific objects and advantages of the instant invention will become readily apparent to those skilled in the art from the following detailed descriptions of preferred embodiments thereof taken in conjunction with the drawings in which:

FIG. 1 is a perspective view of a device for stacking and wrapping coins constructed in accordance with the teachings of the instant invention;

FIG. 2 is a vertical sectional view taken along the line 2—2 of FIG. 1;

FIG. 3 is an exploded fragmentary perspective view of the forward portion of the device of FIG. 1;

FIG. 4 is a front elevation view of the device of FIG. 1;

FIG. 5 is an elevational view of a fragmentary portion of the rear side of the movable member illustrated in FIG. 3;

FIG. 6 is a perspective view of an alternate device embodying the principles of the instant invention;

FIG. 7 is an exploded perspective view of the device of FIG. 6;

FIG. 8 is a vertical sectional view taken along the line 8—8 of FIG. 7;

FIG. 9 is a front elevation view of the device of FIG. 6;

FIG. 10 is a vertical sectional view taken along the line 10—10 of FIG. 8;

FIG. 11 is an enlarged fragmentary frontal view of the upper portion of the component seen in FIG. 10;

FIG. 12 is a perspective of yet another embodiment of the instant invention;

FIG. 13 is an elevation view of the slide member used in connection with the embodiment of FIG. 12;

FIG. 14 is an enlarged fragmentary vertical sectional view taken along line 14—14 of FIG. 12;

FIG. 15 is a front elevational view of the device of FIG. 12;

FIG. 16 is a perspective view of yet another embodiment of the instant invention; and FIG. 17 is an enlarged fragmentary perspective view of the central front portion of the device of FIG. 12 and illustrating an alternate slide means for use in connection therewith.

DETAILED DESCRIPTION OF THE PREFERRED EMBODIMENTS

Turning now to the drawings, in which like reference characters indicate corresponding elements throughout the several views, attention is first directed to FIG. 1 which illustrates a device for stacking and wrapping coins in accordance with the teachings of the instant invention. Included is a body, generally designated by the reference character 20, which functions as first means for receiving and stacking coins. Also included is a movable member, generally designated by the reference character 22, which removably holds a tubular wrapper for receiving the coins after stacking.

More specifically, as seen with further reference to FIG. 2, portion 20 includes top surface 23 and bottom surface 24. For purposes of orientation, body portion 20 is considered to have a forward end 25 and a rearward end 27. It is noted that top surface 23 is angularly disposed relative bottom surface 24 to reside at a downwardly rearward angle when bottom surface 24 is placed upon a substantially horizontal supporting surface such as the top of a table or desk.

A plurality of coin receiving and stacking means are formed into top surface 23. In the embodiment herein chosen for purposes of illustration, the coin receiving and stacking means are in the form of first, second, third and fourth troughs 28, 29, 30 and 32 respectively. First trough 28, as specifically illustrated in FIG. 2, extends along a longitudinal axis represented by the broken line A between an open end 33 proximate forward end 25 of portion 20 and a closed end 34 proximate the rearward end 27 of base 20. Similarly, second trough 29, third trough 30 and fourth trough 32 extend along the axes represented by the broken lines designated by the reference characters B,C, and D, respectively, and terminate proximate rearward end 27 of body portion 20 with closed ends 35, 37 and 38, respectively. The respective open ends 39, 40 and 42 are seen in FIG. 3. Preferably, the several axis a, B, C and D are mutually parallel and also parallel to top surface 23 of body portion 20.

Each trough is sized and shaped to receive a predetermined quantity of coins of a selected denomination. The coins are received in stacked arrangement on edge substantially perpendicular to the axis such that the first coin in the stack bears against the closed end of the respective trough. Accordingly, each trough is arcuate in cross-section to correspond to at least a portion of the outside diameter of a coin of a selected denomination. Similarly, the length of the trough corresponds to the length of the stack of the predetermined quantity of coins of the selected denomination.

For purposes of illustration, the immediate embodiment of the invention is especially devised to handle a single stack of each of the commonly circulated coins. Trough 32 is especially adapted for handling pennies while the troughs 30, 29 and 28 are configured to receive nickels, dimes and quarters, respectively. In cross-section each trough corresponds to the outside diameter of the respective coin. The length of each trough is determined by the number of coins packaged in a single roll. For example, trough 32 is of sufficient length to receive 50 pennies.

An enlarged portion 43 extends laterally along forward end 25 of body 20. A groove 44, functioning as guide means for movably supporting movable member 22, is carried by enlarged portion 43 to extend transverse of body 20. Groove 44 is defined by elongate opening 45 in forward end 25 of body 20 and opposed substantially upright wall 47 which lies in the plane common to the open ends of each of the several troughs. Upper and lower spaced apart side walls 48 and 49, respectively, extend between opening 45 and upright wall 47. Opening 45 is narrower than upright wall 47. Accordingly, each sidewall 48 and 49 is defined by a pair of offset surfaces having a shoulder therebetween. Sidewall 48 includes first surface 50 extending inwardly from forward end 25 of body portion 20 and second surface 52 extending outwardly from upright wall 47. Shoulder 53 extends upwardly forward from surface 50 to surface 52. Sidewall 49, being a substantial mirror image of sidewall 48, includes first surface 54, second surface 55 and angular shoulder 57.

Movable member 22, which is sized and shaped to be slideably received within groove 44, includes outer surface 58 which projects through elongate opening 45, inner surface 59 which resides in opposition to upright wall 47 and upper and lower surfaces 60 and 62 therebetween. Upper surface 60 and lower surface 62 are shaped; to be matingly received by the upper sidewall 48 and lower sidewall 49, respectively, of groove 44. Accordingly, movable member 22 is slidingly movable in opposite directions along a linear axis, represented by the broken line designated by the reference character E, which is perpendicular to the axis of each of the several grooves.

First bore 63, second bore 64, third bore 65 and fourth bore 67 extend through movable member 22 between outer surface 58 and inner surface 59. Functioning as engagement means for removably holding a tubular wrapper, each bore is cylindrical having a diameter corresponding to the outside diameter of the tubular wrapper for the respective denomination. Accordingly, a terminal portion of the wrapper is receivable within the respective bore.

Movable member 22 is movable relative body portion 20 in opposite directions as represented by the double arrowed line F. Pin 68 projects rearwardly from surface 59 of movable member 22 as especially seen in FIGS. 2 and 5. Slot 69, as best viewed in FIG. 3, projects into body 20 from upright wall 47 and receives pin 68. Slot 69 is elongate in a direction parallel to the axis of movement of movable member 22. The abutment of pin 68 against the ends of slot 69 limits the movement of movable member 22 in either of the directions indicated by the doubled arrowed line F. With particular reference to FIG. 4, it is seen that movement in a first direction, as represented by the arrowed line G, is limited to a first position in which inner wall 59 blocks at least a portion of each of the several troughs. Accordingly, surface 59 functions as stop means for closing the open end of each trough and limiting the length thereof to the desired predetermined quantity of coins held in the respective trough. Movement in a second direction, represented by the arrowed line H, is limited to a second position of movable member 22 in which the respective bores are aligned with the respective troughs. Alignment is defined as the bore being substantially concentric about the axis of the respective bore. For example, bore 63 is concentric about the axis of trough 28 as represented by the broken line A.

Each trough has a radius of curvature to accommodate the respective coin. Each bore has a radius of curvature to accommodate the respective tubular wrapper. Referring again to FIG. 2, it is seen that radius of curvature of bore 63 is greater than the radius of curvature of trough 28 to accommodate the thickness of the tubular wrapper. Accordingly, an annular portion of upright wall 47 resides within the circle defined by bore 63 at inner surface 59. The annular portion functions as abutment means for limiting the insertion of the tubular wrapper into bore 63. To facilitate the insertion of the tubular wrapper, each bore is provided with a countersunk or beveled surface 70 adjacent surface 58. Further seen in FIG. 2, is cylindrical opening 72 extending from trough 28 through upright wall 47. Being an extension of trough 28, opening 72 is concentric about axis A and has a radius of curvature corresponding to trough 28. The opening 72 further functions as a guide for directing the coins from trough 8 into the tubular member supported by bore 63. Although not specifically illustrated, but as will be appreciated by those skilled in the art, a similar opening is associated with each trough.

In operation, movable member 22 is first moved in the direction of arrowed line G to the first position in which the movable member closes the open end of each of the troughs. Coins are then placed in the respective troughs. If the coins to be stacked and rolled are of randomly selected denominations, sorting is readily accomplished during placement of the coins in the respective troughs. Since each trough is inclined, downwardly rearward, the stack of coins will tend to move in a direction toward the rearward end of body 20 with the face of the first coin bearing against the closed end of the trough. After the stacking and sorting operation is completed, the terminal portion of a tubular wrapper is inserted into each of the wrapper engagement means. The wrappers are inserted into the respective counterbores until the end of the wrapper abuts the surface projecting from the open end of the troughs. The movable member is then moved in the direction of arrowed line H into the second position. Subsequently, the rearward end of the body is raised causing each trough to be tilted with the open end downwardly thereby causing the coins to pass from the trough through the guide means into the tubular wrapper. Subsequently, the tubular wrapper is removed and the end thereof which resided within the bore is closed in accordance with conventional practice.

Attention is now directed to FIG. 6 wherein there is illustrated an alternate embodiment of the instant invention which, in general similarity to the previously described embodiment includes, a body generally designated by the referenced character 80 and a movable member generally designated by the referenced character 82. The immediate embodiment further includes a base generally designated by reference character 83.

With further reference to FIGS. 7 and 8, it is seen that body 80 is generally elongate and rectangular in cross-section. For purposes of orientation, body 80 is considered to have forward end 84, rearward end 85 and angularly disposed first, second, third and fourth surfaces 87, 88, 89 and 90, respectively. First trough 92 having closed end 93 proximate rear end 85 of body 80 and open end 94 at forward end 90 of body 80 is formed in first surface 87. Fingertip accommodating recess 95 is formed into first surface 87 at closed end 93.

Trough 92 is elongate along an axis, represented by the broken line I, for a length corresponding to the predetermined number of coins of a selected denomination in a stack. Trough 92 is arcuate in cross-section having a radius of curvature corresponding to the outside diameter of the coin of the selected denomination. In general, trough 92 is analogous to the previously described trough 28 having a length and radius of curvature for accepting forty quarters, the established standard for a single roll having a value of ten dollars.

Trough 97 formed into second surface 88, extends along an axis represented by the broken line J between closed end 98 and open end 99. Recess 100 is formed into surface 88 at closed 98. Similar to previously described trough 29, trough 97 is sized and shaped to receive and stack a predetermined number of coins of selected denomination, specifically fifty dimes such that the completed roll has a value of fifty dollars.

Additional troughs 102 and 103 are formed into surfaces 89 and 90, respectively. Although not specifically illustrated and described, but as will be appreciated by those skilled in the art, each trough 102 and 103, embodies the features of previously described troughs 92 and 97 including a closed end and an open end. Also provided are recesses at the closed end. In size and shape, troughs 102 and 103 correspond to previously described troughs 30 and 32, respectively. Trough 102 is especially adapted for receiving nickels while trough 103 is especially devised for stacking pennies. Further, each trough 102 and 103 extends along a respective axis. The axes of the several troughs are parallel.

Cylindrical projection 104 carrying threaded bore 105 extends rearwardly from rearward end 85 of body 80. A second threaded bore 107 extends into body 80 from forward end 84. Projection 104, threaded bore 105 and second threaded bore 107 are axially aligned along the longitudinal axis of body 80 as represented by the broken line designated by the reference character K. The axes of the several troughs are parallel to the axis represented by the reference character K. Further description of the threaded projection 104 and of the bores 105 and 107 will be made presently.

With further reference to FIGS. 6, 7 and 8 it is seen that base 83 includes forward 110, rearward end 112, top surface 113 and bottom surface 114. Stanchion 115 having forwardly facing upright surface 117 projects upwardly from top surface 113 proximate rearward end 112.

Surface 117 is at an incline extending upwardly rearward from surface 113. Bore 118 extends through stanchion 115 along an axis which is substantially perpendicular to the surface 117. Counterbore 119 extends into stanchion 115 from surface 117 while second counterbore 120 extends into stanchion 115 from rearward end 112. Counterbore 119 functions as a bearing surface for rotatably receiving cylindrical projection 104. The coupling between body 80 and base 83 is maintained by bolt 122 having shank 123 which passes through bore 118 and is threadingly engaged with the threaded bore 105 of body 80. Head 124 of bolt 122 resides within counterbore 120. With surface 85 in juxtaposition to surface 117, body 80 is carried by base 83 to reside at an upwardly forward incline. Further, body 80 is rotatable about the axis represented by the broken line K in opposite positions as indicated by the doubled arrowed arcuate line designated by the reference character L. For minimum height of stanchion 115 and a low profile of the entire device, recess 125 formed into top surface 113 of base 83 provides clearance for rotation of body 80 relative base 83.

Movable member 82 includes outer surface 127, inner surface 128 and axial bore 129 with counterbore 130 extending inwardly from outer face 127. Bolt 132 having shank 133 extending through bore 129 and threadingly engaged within 107 and head 134 residing in counterbore 130 secures movable member 82 to body 80 with surface 128 in juxtaposition to surface 84. Movable member 82 is rotatable about axis K in opposite directions as indicated by the arcuate doubled arrowed line M.

First, second, third and fourth bores, 135, 137, 138 and 139 respectively, as best seen in FIG. 10, extend through movable member 82 between the surfaces 127 and 128. Each bore is aligned along an axis which is parallel to the axis of rotation of movable member 82. Each bore is provided with a counterbore extending inwardly from outer surface 127. Counterbore 140 is coaxial with bore 135, counterbore 142 is aligned with bore 137, counterbore 143 is concentric with bore 138 and counterbore 144 is aligned with bore 139. As best viewed in FIGS. 8 and 11, an annular shoulder 145 resides intermediate each respective bore and counterbore. Adjacent outer surface 127, each counterbore is provided with a countersink or beveled surface 147.

Pin 148 projects from forward end 84 of body 80. Slot 149, formed into movable member 82 from the inner surface 128, receives pin 148. Slot 149 is arcuately elongate along an axis which rotates about the axis K. One end of slot 149 is stopped while the other end is open into bore 135.

As a result of the engagement of pin 148 within slot 149, movable member 82 is rotatable within limits in opposite directions about the axis K as represented by the arcuate arrowed lines N and O seen in FIG. 9. Rotation in the direction of arrowed line O is limited to a first position in which pin 148 abuts the sidewall of bore 135. Rotation in the direction of arrowed line N is limited to a second position in which pin 148 abuts the stopped end of slot 149. In the first position, inner surface 128 of movable member 82 closes at least a portion of each of the troughs 92, 97, 102 and 103. In the second position, each bore is aligned with the respective trough. That is, bore 135 is aligned with trough 92, bore 137 is aligned with trough 97, bore 138 is aligned trough 102 and 139 is aligned with trough 103.

The function and operation of the immediate embodiment is generally analogous to the function and operation of the previously described embodiment. However, the immediate embodiment is devised for stacking and wrapping of a single roll of coins of selected denomination. Body 80 is rotatable relative base 83 such that the surface containing the trough corresponding to the selected denomination of coins can be placed to face upwardly. For this reason, movable member 82 rotates more freely relative body 80 than body relative base 83. The relative difference in ease of rotation is preferably a result of the friction between the relative components which is readily adjusted by relative tightening of the respective assembly bolts.

Initial rotation of movable member 82 in the direction indicated by the arrowed line O positions the movable member in the first position with the sidewall of bore 135 against pin 148 with rearward surface 128 effectively closing each of the troughs. In response to continued rotation in the direction of arrowed line O, body 80 is rotated to position the selected trough in the operative or upwardly facing position. Coins of the selected denomination are then placed in the trough, on edge, as previously described. The length of the closed trough predetermines the quantity of coins to be stacked. After the stacking is completed, a tubular wrapper is inserted into the counterbore to abut the annular shoulder. Thereafter, movable member 82 is rotated in the direction of arrowed line N in which pin 148 is received within slot 149 with the member coming to a stop when the wrapper is axially aligned with the stack of coins. A stack of coins and a wrapper are shown in broken outline and designated 150 and 152, respectively, in FIG. 8. Subsequently, the device is tipped such that the coins will move from the trough into the wrapper. During this operation, the bore functions as a guide for directing the coins into the wrapper. Finally, the wrapper, with coins therein, is removed from the device and sealed in accordance with conventional procedure.

FIG. 12 illustrates yet another embodiment of the instant invention including a body, generally designated by the reference character 160 which, being generally analogous to the previously described body portion 20, includes top surface 163, bottom surface 164, forward end 165 and rearward end 167. In further analogy to body portion 20, the immediate body portion additionally includes first trough 168, second trough 169, third trough 170 and fourth trough 172 formed into top surface 163. The several troughs 168, 169, 170 and 172 extend longitudinally from closed ends 173, 174, 175 and 177, respectively, proximate rearward end 167.

An enlarged portion 178, having an appearance generally similar to the previously described enlarged portion 43, is carried at the forward end 165 of body 160. As seen with further reference to FIG. 14, trough 168 extends along a longitudinal axis represented by the broken line P and terminates within enlarged portion 178 with open end 179. A bore 180 coaxial with axis P is integral with the open end 179 of trough 168. Although not specifically illustrated, it is understood that each of the other troughs includes a similarly constructed open end and extends along an axis which is parallel to the axis P.

In all aspects, the structure and the function of the above described elements carried by body 160 are analogous to the structure and the function of corresponding elements carried by the body portion 20.

First, second, third and fourth counterbores 182, 183, 184 and 185 are formed into enlarged portion 178 from forward end 165. As better seen in FIG. 14, first counterbore 182, which is concentric with axis P, terminates with annular shoulder 187 coincident with the open end 179 of trough 168. Countersink 187 forms an annular beveled surface at the juncture of counterbore 182 and surface 165. It is understood, though not specifically illustrated, that each of the other counterbores extends between an annular shoulder and an annular beveled surface and is coaxial with the axis of the respective trough.

The function of each counterbore is for frictional engagement of the terminal portion of tubular coin wrapper as previously described.

Unique to the immediate embodiment, as additionally illustrated in FIG. 13, is slide member 190, a plate-like structure having upper and lower parallel edges 192 and 193, respectively. First, second, third and fourth openings 194, 195, 197 and 198, respectively, pass through slide member 190. A slot 199 formed in enlargement 178 slideably receives slide member 190.

Slot 199 extends transverse of body 160 along an axis represented by the broken line Q which lies in the plane of slot 199 and alide member 190 which is perpendicular to the axes of the several troughs. Accordingly, slide member 190 is reciprocally movable in opposing linear directions as indicated by the double arrowed line R. A terminal portion 200 of slide member 190 projects beyond enlarged portion 178 and functions as a finger grip for manual manipulation for selective movement along the axis Q. Slot 202, elongated in a direction generally parallel to the axis Q, is formed through slide member 190. Pin 203, carried in enlarged portion 178, projects through and is slideably received within slot 202.

As determined by the abutment of respective ends of slot 202 with pin 203, the movement of slide member 190 is limited to a first position in the direction of arrowed line S and to a second position in the direction of arrowed line T. For reference, arrowed lines S and T are components of the previously noted doubled arrowed line R. In the first position, a solid portion of slide member 190 resides adjacent the open end of each trough for limiting the number of coins stacked therein to a predetermined quantity. Reference is made to FIG. 15 wherein slide member 190 has been moved in the direction indicated by the arrowed line S, but not necessarily to the limit of movement in the indicated direction. Seen through each counterbore is a solid portion of the slide member 190 adjacent the respective openings. For the purpose of passage of coins through the guide means, the open end of each respective trough is considered to be closed or terminated. In response to movement of slide member 190 into the first position, limit of movement in the direction of arrowed line T, first opening 194, second opening 195, third opening 197 and fourth opening 198 assume a position coaxially with the respective axis of first trough 168, second trough 169, third trough 170 and fourth trough 172. Each opening is sized to receive therethrough a coin of the denomination stacked within the respective trough. Accordingly, the coins may be transferred from the trough into the tubular wrapper held within the respective engagement means. The act of transferring the coins is accomplished in response to the urging of finger pressure or the tilting of body 160 as previously described.

Referring now to FIG. 16 there is seen an alternate embodiment of the instant invention including a body, generally designated by the reference character 210 having top surface 212 and enlarged portion 213. In common with the embodiment illustrated in FIG. 12, the immediate embodiment includes first, second, third and fourth troughs 168, 169 170 and 172, respectively, formed into top surface 212 and slide member 190. In the foregoing and all other aspects not specifically noted, the immediate embodiment includes the elements described in detail in connection with the embodiment of FIG. 12.

The immediate embodiment is distinctive from the embodiment of FIG. 12 by virtue of bottom surface 214 which in angularly disposed to surface 212 such that each trough extends along an upright axis. Each trough, as will be appreciated by those skilled in the art, is inclined as necessary to insure that the coins stacked therein tend, as a result of gravity, to bear against the trough. During the stacking operation, the first coin of the stack will bear against a solid portion of slide member 190 instead of the closed end of the respective trough. The immediate embodiment is especially adapted to reside at an elevated location, such as the edge of a table or upon a stand, to allow sufficient clearance for insertion of the tubular wrappers into the respective engagement means.

With reference to FIG. 17 there is seen yet another modification which may be practiced in connection with the embodiment described in connection with FIG. 12. Seen is slide member 220 having upper edge 222 from which extends tab 223. Although not specifically illustrated, slide member 220 does not include slot 202 and terminal portion 200. In all other aspects not specifically illustrated or described, especially the inclusion of openings 194, 195, 197 and 198, slide member 220 is analogous to previously described slide member 190.

Body 224 having enlarged portion 225 is analogous to body 160 and enlarged portion 178, respectively, including slot 199 for slideably receiving slide member 220. Opening 207, enlongated in a direction corresponding to the directions of movement of slide member 220 projects from slot 199 upwardly through enlarged portion 225. Tab 223 functions as grasping means for movement of slide member 220 into the previously described first and second positions as determined by the abutment of tab 223 with respective ends of opening 207. In all other aspects not specifically described in detail, structure and function of the immediate embodiment is analogous to the embodiment described in detail in connection with FIG. 12. It will be appreciated, that the immediate modification is also usable in connection with the embodiment illustrated in FIG. 16.

Various modifications and changes to the embodiments herein chosen for purposes of illustration will readily occur to those skilled in the art. For example, while the embodiment of FIG. 1 has been described and illustrated as containing four troughs, each sized and shaped to receive coins of differing denominations, it is within the scope of the instant invention that the device may be fabricted to include differing numbers or configurations of troughs. A device including a single trough or a plurality of troughs for a single denomination of coin are envisioned. Also, other means for coupling the components and for limiting the relative movement therebetween, will be readily apparent to those skilled in the art. Further, the devices may be fabricated of any selected materials such as plastics, wood, or metal. To the extent that such modifications and variations do not depart from the spirit of the invention, they are intended to be included within the scope thereof which is limited only by a fair assessment of the following claims.

Having fully described and disclosed the instant invention and alternately preferred embodiments thereof in such clear and concise terms as to enable those skilled in the art to understand and practice the same invention claimed is:

1. A device for receiving and stacking a predetermined number of coins of selected denomination and for holding a tubular wrapper for receiving said coins, said device comprising:

a. first means for receiving and stacking coins of selected denomination; and b. second means movably carried by said first means for holding a tubular wrapper and selectively positionable between i. a first position for limiting said first means to receiving a predetermined number of coins; and ii. a second position for transfer of said predetermined number of coins to said tubular wrapper.

2. The device of claim 2, wherein:

a. said first position is reached in response to movement of said second means in a first direction; and b. said second position is reached in response to movement of said second means in a second direction opposite to said first direction.

3. The device of claim 2, wherein said movement in said first direction and in said second direction is along a continuous linear path.

4. The device of claim 2, wherein said movement in said first direction and in said second direction is along a continuous arcuate path.

5. The device of claim 2, further including stop means for limiting movement of said second means in said first direction to said first position and in said second direction to said second position.

6. The device of claim 1, wherein said second means includes engagement means for receiving and removably holding said tubular wrapper.

7. The device of claim 4, further including guide means for directing coins from said first means into said tubular wrapper when said second means is in said second position.

8. The device of claim 7, wherein said guide means are carried by said first means.

9. The device of claim 7, wherein said guide means are carried by said second means.

10. A device for stacking a plurality of assorted coins and for transferring the stacked coins into tubular wrappers, said device comprising:

a. a body including at least;

i. first stacking means for receiving a first quantity of coins, and ii. second stacking means for receiving a second quantity of coins; and b. a movable member carried by said body and including at least;

i. first engagement means for removably holding a first tubular wrapper for receiving said first quantity of coins; and ii. second engagement means for removably holding a second tubular wrapper for receiving said second quantity of coins;

said movable member bind selectively positionable between a first position for limiting said first and second stacking means to receiving a predetermined quantity of coins, and a second position for transfer of said first and said second quantity of coins into the respective said tubular wrapper.

11. The device of claim 10, wherein each said stacking means includes:

a. a trough for receiving in stacked arrangement the respective said quantity of coins and having;
i. a closed end,
ii. an open end, and
iii. a length intermediate said ends corresponding to said stacked arrangement, and
b. stop means carried by said movable member for closing the open end of said trough in opposition to the closed end when said movable member is in said first position.

12. The device of claim 11, further including guide means for guiding each said quantity of coins from the respective said trough into the respective said tubular wrapper when said movable member is in the second position.

13. The device of claim 12, wherein:
a. said guide means includes a bore extending through movable member and sized to receive the respective quantity of coins therethrough,
said bore residing in substantial alignment with the open end of the respective trough when said movable member is in said second position; and
b. said engagement means includes a counterbore carried by said movable member in substantial concentricity with said bore and sized to receive and removably support the respective said tubular wrapper.

14. The device of claim 10, wherein:
a. said body includes a surface having said first and said second stacking means formed therein and extending along substantially parallel axes; and
b. said movable member is movable between said first and said second positions in opposite directions along a linear axis substantially perpendicular to the axes of said stacking means.

15. The device of claim 14, further including limit means for limiting movement of said movable member in said opposite directions along said linear axis to said first and said second positions.

16. The device of claim 14, wherein the axes of said first and said second stacking means normally reside at an incline extending downwardly from said movable member.

17. The device of claim 10, wherein:
a. said body includes
i. a first surface having said first stacking means formed therein along an axis, and
ii. a second surface angularly disposed to said first surface and having said second stacking means formed therein along an axis substantially parallel to the axis first of said stacking means; and
b. said movable member is movable between said first and said second positions in opposite directions about an axis of rotation substantially parallel to the axes of said stacking means.

18. The device of claim 17, further including limit means for limiting movement of said movable member in said opposite directions about said axis of rotation to said first and said second directions.

19. The device of claim 17, further including:
a. a stationary base; and
b. mounting means rotatably affixing said body to said base for rotation between
a first position in which said first stacking means is positioned for receiving said first quantity of coins, and
a second position in which said second stacking means is positioned for receiving said second quantity of coins.

20. The device of claim 19, wherein said body is rotatable about an axis of rotation which is coincident with the axis of rotation of said movable member.

21. The device of claim 20 wherein the axis of rotation of said body portion normally resides at an incline extending downwardly from said movable member.

22. The device of claim 10, wherein said first and said second quantity of coins are of the same demonimation and said first and said second stacking means are coincidently sized and shaped.

23. The device of claim 10, wherein said first and said second quantity of coins are of differing denominations and said first and said second stacking means are respectively sized and shaped.

24. The device of claim 12, wherein:
a. said guide means includes a first bore carried by said body in substantial alignment with the open end of the respective trough and sized to receive the respective quantity of coins therethrough; and
b. said engagement means includes a second bore extending through said movable member and residing in substantial axial alignment with said first bore when said movable member is in said second position.

* * * * *